United States Patent [19]

Ochi et al.

[11] 4,455,347

[45] Jun. 19, 1984

[54] ACRYLIC FIBERS HAVING IRREGULAR-FORM SECTION AND PROCESS FOR PRODUCING THE SAME

[75] Inventors: Mitsutoshi Ochi; Yoshinobu Kotera; Masaki Sugiyama, all of Hiroshima, Japan

[73] Assignee: Mitsubishi Rayon Co., Ltd., Tokyo, Japan

[21] Appl. No.: 365,690

[22] Filed: Apr. 5, 1982

[30] Foreign Application Priority Data

Apr. 3, 1981 [JP] Japan ..... 56/50340

[51] Int. Cl.[3] ..... D02G 3/00; C09C 1/56

[52] U.S. Cl. ..... 428/369; 428/376; 428/398; 428/400; 264/177 F

[58] Field of Search ..... 428/369, 400, 376, 398; 264/177 F, 182

[56] References Cited

U.S. PATENT DOCUMENTS

| | | | |
|---|---|---|---|
| 3,621,087 | 11/1971 | Shimamura et al. | 264/177 F |
| 3,802,954 | 4/1974 | Orito et al. | 428/400 |
| 4,082,174 | 4/1978 | Ishikawa et al. | 428/398 |

*Primary Examiner*—George F. Lesmes
*Assistant Examiner*—Beverly Johnson
*Attorney, Agent, or Firm*—Sughrue, Mion, Zinn, Macpeak and Seas

[57] ABSTRACT

An acrylic fiber having an irregular form section and a ramie-like feeling, wherein the section of the fiber has unmethodical surface unevenness and has at least two concave parts which has a ratio of the length l of a perpendicular from a tangental line between adjacent convex parts of said unevenness to the deepest part of the concave part to the diameter $D_1$ of a circumscribed circle: $l/D_1$ of 0.05 or more, and the surface of said fiber is covered with many discontinuous creases having an average width of 1μ or more provided along the lengthwise direction of the fiber, and process for producing the same.

5 Claims, 4 Drawing Figures

ACRYLIC FIBERS HAVING IRREGULAR-FORM SECTION AND PROCESS FOR PRODUCING THE SAME

BACKGROUND OF THE INVENTION

1. Field of the Invention

The present invention relates to acrylic synthetic fibers having an irregular deeply uneven section the surface of which is covered with discontinuous crease parts to form deep unevenness, which are quite different from acrylic fibers having a round section or a dog bone section developed hitherto, and, particularly, to acrylic synthetic fibers suitable for spring clothes and summer clothes which have a ramie-like feeling and a linen-like luster.

In acrylic synthetic fibers, it is very difficult to produce fibers having an irregular-form section by a spinning operation because of characteristics of the polymer, and the fibers generally have a round section or a dog bone section. Further, the acrylic fibers have not only the above described shape of the section but also a peculiar warm feeling themselves. Accordingly, they have an aptitude as winter clothes but do not have an aptitude as summer clothes. Therefore, the acrylic fibers are subject to restriction in the viewpoint of their use, and it has been greatly desired to develop the use of acrylic fibers so as to obtain acrylic fibers having an aptitude as summer clothes. However, acrylic fibers having such characteristics have not been developed yet.

It is an object of the present invention to develop acrylic fibers suitable for raw materials of summer clothes which have a ramie-like feeling characterized by a dry and fresh feeling and a peculiar elegant linen-like luster by which the use of acrylic fibers is expanded.

A characteristic of the present invention is the fibers which have an irregular form section wherein at least two convex-concave parts having an unevenness value represented by $l/D_1$ of 0.05 or more are present in the section of fibers and the surface of fibers is covered with many creases having an average width of $1\mu$ or more which are provided along the lengthwise direction of the fibers.

Another characteristic of the present invention is a process for producing the above described fibers wherein a wet spinning process is utilized, a spinning nozzle having a triangular orifice is used as the spinning nozzle, a spinning solution dope having a low viscosity, particularly, that having a viscosity of 30 to 120 poises which is not used for the prior acrylic fiber producing process by a wet spinning is used as the organic spinning solution dope, and drying of fibers after conclusion of spinning is carried out at 105° to 160° C., by which fibers having the above described specified irregular form section are produced.

A further characteristic of the present invention is to blend yarns having an excellent water absorption property and good physical properties which comprise 50 to 90% of substantive fibers having the above described specified irregular form section which does not contain voids and 10 to 50% of fibers having the above described specified irregular form section which contains capillary voids.

2. Description of the Prior Art

Acrylic fibers developed hitherto have been advantageously utilized as raw materials for winter clothes, because the most typical characteristic of the fibers is to have a warm wool-like feeling. However, since acrylic fibers are wool-like fibers having a warm touch or a slipperious feeling and they have characteristics such as an inferior moisture absorbing or diffusing property, etc., they are not suitable as raw materials for spring clothes and summer clothes. Therefore, it has been believed that application of acrylic fibers is inferior to that of polyester fibers.

Various proposals for giving a sweat absorbing property to the acrylic fibers have been done, one of which is seed-core type acrylonitrile fibers described in Japanese Patent Application (OPI) No. 149923/76 (the term "OPI" as used herein refers to a "published unexamined Japanese patent application"). In that invention, the core component of the fibers is composed of a copolymer of acrylonitrile and a comonomer represented by the formula $$CH_2{=}\overset{\overset{\displaystyle R}{|}}{C}{-}CO{-}(OCH_2CH_2)_n{-}(OCH_2{-}\overset{\overset{\displaystyle R_1}{|}}{C}H){-}R_2$$

and the core component has a void structure. Although these acrylonitrile fibers have a good hygroscopic property as compared with acrylonitrile fibers developed hitherto, the state of the surface thereof is similar to that of the prior fibers and the fibers are still wool-like.

Further, U.S. Pat. No. 3,929,946 discloses hygroscopic acrylic fibers containing 63% or less of capillary voids, wherein the free surface area including the surface of voids is $10\times10^4$ to $1.7\times10^6$ $cm^2/g$. These fibers have a good characteristic in the viewpoint of hygroscopic property, but they are not suitable as raw materials of summer clothes because of having a wool-like feeling.

Furthermore, it has been proposed in British Pat. No. 1,532,770 a process for producing fibers having a core-jacket structure and containing microvoids in the core part which comprises carrying out dry spinning of a spinning solution dope composed of an acrylonitrile polymer and a solvent to which polyhydric alcohol, methyl hydroxybenzoate, isophthalic acid, pyromellitic acid, zinc chloride or magnesium chloride, etc., is added. The fibers obtained by this process has a good hygroscopic property, but the hand and the external appearance of them are no better than wool-like feelings.

Further, it has been studied to develop acrylonitrile fibers having an uneven surface.

One of such studies has been described in Japanese Patent Application (OPI) No. 158322/80, which discloses a process for producing acrylonitrile fibers having an aptitude of artificial hairs which comprises spinning a spinning solution dope obtained by dissolving an acrylonitrile polymer composed of 30 to 55% by weight of acrylonitrile and 45 to 70% by weight of vinylidene chloride or vinyl chloride in an acetone solution by a wet spinning process. Fibers obtained by this process have an uneven pattern on the surface thereof and have good properties for artificial hairs, but they do not have fresh and dry feelings but have wool-like feelings. The polymer constituting these fibers are not suitable as fibers for cloths, because an amount of acrylonitrile copolymerized is as low as 55% by weight. When it is intended to produce fibers of an acrylonitrile polymer having a higher acrylonitrile content, a spinning solution dope cannot be formed because the acrylonitrile polymer does not dissolve in acetone, and, consequently, the objective fibers cannot be produced.

Moreover, Japanese Patent Application (OPI) No. 15832/80 discloses acrylonitrile fibers having two or more macrovoids having a longer diameter of 2μ or more in the section of the fibers the surface of which has numbers of creases having an average width of 0.1 to 5μ provided along the lengthwise direction. These fibers are useful because of having cotton-like feelings, but a linen-like feeling and a ramie-like luster are not obtained yet because uneven creases formed on the surface are not deep. Accordingly, they are not sufficient as raw materials for summer clothes. Further, fibers containing a large volume of voids in the interior are not sufficient in the viewpoint of physical fibrous properties.

DETAILED DESCRIPTION OF THE INVENTION

Figure 4:
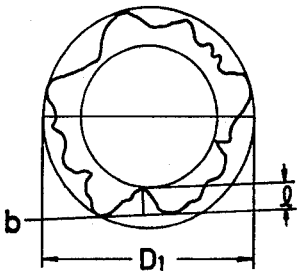
FIG. 4 is a model view of the section of a fiber or the present invention, wherein $D_1$ is the diameter of a circumscribed circle, b is a tangental line between adjacent convex parts, and l is the length of a perpendicular from the tangental line b to the deepest concave part.

The present invention relates to acrylic synthetic fibers having a ramie-like dry feeling and a ramie-like luster, wherein the section of the fibers has irregular surface unevenness which has at least two concave parts having a ratio of the length l of a perpendicular from the tangental line b between adjacent two convex parts to the deepest concave part to the diameter $D_1$ of the circumscribed circle of said fibers; $l/D_1$ being 0.05 or more, and the surface of the fibers is covered with crease parts having an average width of 1μ of more provided along the lengthwise direction. As shown in FIG. 4, the measurement of $l/D_1$ can be carried out by making a section view of the fiber from an enlarged microscopic photograph, and measuring the diameter $D_1$ of the circumscribed circle and the length l of the perpendicular from the tangental line between two convex parts to the deepest part of the concave part formed by the two convex parts.

When $l/D_1$ is less than 0.05, the object of the present invention cannot be attained, because fibers having a wool-like or cotton-like feeling are only obtained. It is preferred that the value of $l/D_1$ is generally 0.05 to 0.20. However, a too large value is not preferred, because physical properties of the fibers deteriorate.

Further, it is an object of the present invention to provide acrylic fibers having an excellent water absorbing characteristic which are obtained by blending 50 to 90% of nearly substantive fibers having the above described peculiar irregular form section and a surface structure having crease parts and 50 to 10% of fibers having the similar peculiar structure and containing many capillary voids in the section of fibers.

It is a great characteristic of the present invention that the acrylic fibers are produced by a process which comprises throwing a spinning dope composed of a solution of an acrylonitrile polymer in an organic solvent the viscosity of which measured at 50° C. is 50 to 120 poises in a coagulating bath by means of a spinning nozzle equipped with a triangular orifice, carrying out spinning and washing, and thereafter drying at a temperature of 100° C. or more.

In carrying out the present invention, it is preferred that the acrylonitrile polymer used is a copolymer composed of 70 to 97% by weight of acrylonitrile and 3 to 30% by weight of other copolymerizable vinyl monomers. When the ratio of acrylonitrile in the acrylonitrile polymer becomes small, fibers obtained by spinning the polymer tend to have insufficient properties as fibers for clothes. On the other hand, in a polymer having a larger ratio of acrylonitrile, there is a tendency to deterioration of spinning properties.

Examples of vinyl monomers capable of copolymerizing with acrylonitrile include acrylic acid, methacrylic acid, acrylic acid or methacrylic acid esters such as methyl acrylate or methyl methacrylate, tec., acrylamide, methacrylamide, vinyl chloride, vinylidene chloride, vinyl acetate, vinylbenzenesulfonic acid, methallylsulfonic acid and salts of these sulfonic acids, etc.

As the solvent used for dissolving the above described acrylonitrile polymers, it is preferred to use organic solvents such as dimethylformamide, dimethylacetamide, dimethylsulfoxide or ethylenecarbonate, etc.

The spinning dope prepared by dissolving the acrylonitrile polymer in the above described solvent is preferred to have a viscosity in a range of 50 to 120 poises (measured at 50° C.). In case that the viscosity of the spinning solution is less than 50 poises, it is difficult to produce continuously fibers having the irregular form section structure of the present invention. On the other hand, if the viscosity of the spinning solution is beyond 120 poises, it becomes difficult to produce acrylic fibers having a peculiar irregular form section of the present invention, even though the coagulating condition is controlled. This reason is not obvious, and fibers having the section which has the same section shape as the shape of an orifice composing a jet used for spinning are only obtained. For example, when fibers are produced with using a jet equipped with an orifice having a triangular section, the resulted acrylic fibers have a triangular section similar to the section shape of the orifice and have a surface having a high luster. Accordingly, it it impossible to produce fibers having a linen-like elegant luster and a dry feeling.

The orifice of the jet used for carrying out the present invention may have various shapes, such as a round shape, an ellipse shape, a rectangular shape, or a triangular shape, etc. However, in order to effectively produce fibers having crease parts on the surface wherein the value $l/D_1$ of unevenness is 0.05 or more, it is preferred to use an orifice having a triangular shape and, particularly, an equilateral triangle, or an analogous shape.

The coagulating bath is preferred to use an aqueous solution of the above described organic solvents and the concentration of the organic solvents is preferred to be in a range of 20 to 60%.

The fiber extruded in the coagulating bath is taken out by a haul-off roll from the coagulating bath. In this case, it is preferred that the spinning draft is 2.0 or less. When haul-off is carried out under a condition that the spinning draft is beyond 2, a phenomenon that the operating stability of the subsequent step for drawing the fiber deteriorates is observed. The spinning draft is important in case of producing fibers by blending fibers of a substantive structure and fibers containing capillary voids in a ratio of 1/1 to 9/1, wherein said fibers have irregular form section of the present invention. In this case, it is preferred that the spinning draft is 0.3 or more and, particularly, in a range of 0.5 to 15. The draw ratio is preferred to be in a range of 3 to 6 times.

The drying of fibers is advantageous to carry out at 100° C. or more and, particularly, 105° to 160° C. in case of producing fibers having an irregular form section structure of the present invention. The drying is necessary in the viewpoint of stability of the section structure of fibers in case of, particularly, producing blends of substantive fibers. The fibers of the present invention produced under a condition that the drying temperature is 105° to 160° C. are excellent in dimensional stability, and they do not deform by the subsequent heat treatment such as ironing, etc.

The fibers produced as described above are desired to carry out relaxation in a range of, particularly, 15 to 40% under a saturated steam at 100° C. or more.

In the following, the present invention is illustrated in greater detail by examples.

EXAMPLE 1

A copolymer composed of 91% of acrylonitrile and 9% of vinyl acetate having an intrinsic viscosity of 1.35 was dissolved in dimethylacetamide to prepare spinning solutions having a viscosity at 50° C. described in Table 1. Using a mixture of 30% of dimethylacetamide and 70% of water having 40° C. as the coagulating bath, spinning was carried out by means of a jet having a triangular orifice. Then, the fibers were drawn at 4.5 times in a boiling water, followed by washing and drying at 140° C. The resulted fibers were subjected to relaxation processing in a saturated steam at 125° C. so as to 30%, and a fiber bundle having a monofilament denier of 3 was produced. The resulted fibers were cut in the length of 75 mm. The cut fibers were spun by the conventional method, dyed and knitted to obtain cloth. Results of evaluation of the feeling and luster of the cloth are shown in Table 1.

TABLE 1

| Experiment No. | Viscosity of Spinning Dope (poise) | Shape of Orifice | Shape of Fiber Section | State of Crease $l/D_1$ | State of Crease Average Number | Feeling | Luster | Evaluation |
|---|---|---|---|---|---|---|---|---|
| 1 | 190 | Equilateral triangle of the side of 0.12 mm | Triangle | — | — | Rough stiff touch | Strong luster | x |
| 2 | 170 | Equilaterl triangle of the side of 0.12 mm | Deformed triangle | 0.03 | — | Rough stiff touch | Strong luster | x |
| 3 | 140 | Equilateral triangle of the side of 0.12 mm | Deformed triangle | 0.043 | — | Slight dry touch | Cotton-like luster | Δ |
| 4 | 100 | Equilateral triangle of the side of 0.12 mm | Irregular shape | 0.072 | 2–5 | Dry touch | Ramie-like luster | o |
| 5 | 75 | Equilateral triangle of the side of 0.12 mm | Irregular shape | 0.085 | 3–6 | Dry touch | Ramie-like luster | |
| 6 | 75 | Circle of 0.076 mm in diameter | Irregular shape | 0.04 | — | Slight dry touch | Cotton-like luster | Δ |

: Excellent,
o: Good,
Δ: Fair,
x: Poor

Figure 1:
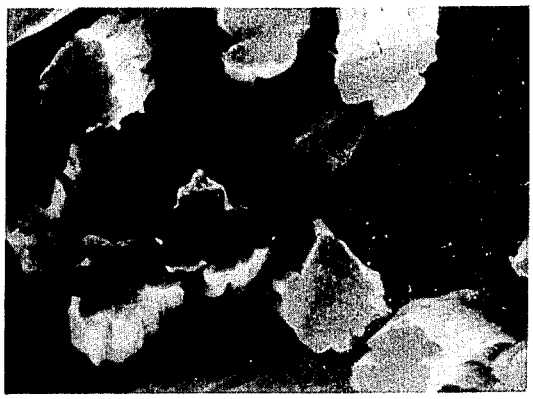
FIG. 1 is an enlarged microscopic photograph (magnification: 900 times) of the section of a fiber of the present invention.
Figure 3:
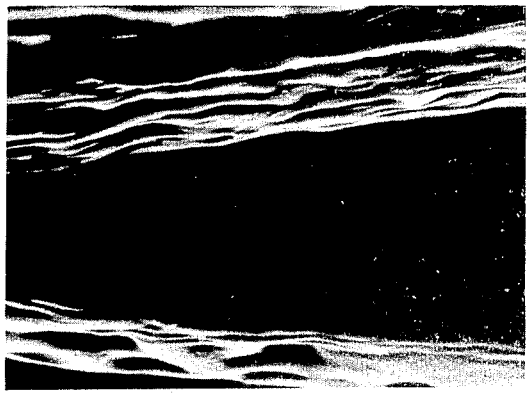
FIG. 3 is an enlarged microscopic photograph (magnification: 900 times) of the side of a fiber of the present invention.

Enlarged microscopic photographs of the shapes of the section and the side of fibers obtained as Experiment No. 5 in Table 1 are shown in FIGS. 1 and 3, respectively. The side of this fiber was covered with many creases having a width of 1μ or more.

EXAMPLE 2

The spinning solution described as Experiment No. 5 in Table 1 of Example 1 was spun by varying the spinning draft as shown in Table 2. Coagulation, drawing, washing, drying and relaxation were carried out under the same conditions as in Example 1. Results of evaluation of properties of the resulted fibers are shown in Table 2.

TABLE 2

| Experiment No. | Spinning Draft | Shape of Fiber Cross Section | State of Crease ($l/D_1$) | Average Content of Capillary Voids | Water Retentivity (%) |
|---|---|---|---|---|---|
| 7 | 0.4 | Oval | 0.03 | 32 | 18 |
| 8 | 1.05 | Irregular form | 0.12 | 43 | 23 |
| 9 | 1.8 | Deformed triangle | 0.04 | 48 | 28 |

Figure 2:
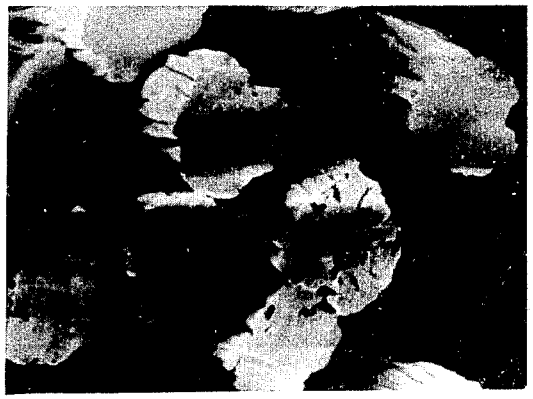
FIG. 2 is an enlarged microscopic photograph (magnification: 900 times) of the section of a fiber composed of a mixture of a substantive fiber and a hollow fiber containing voids of the present invention.

An enlarged microscopic photograph of the section of the fiber obtained in Experiment No. 8 in Table 2 was shown in FIG. 2. The average number of concave parts of this fiber is in a range of 3 to 6, and the surface thereof is covered with many crease parts having a width of 1μ or more. The spinning process stability of Experiment No. 9 is not fine.

EXAMPLE 3

A copolymer composed of acrylonitrile 91% and vinyl acetate 9% having intrinsic viscosity of 1.35 was dissolved in dimethylacetamide to prepare spinning solution having a viscosity of 75 poises at 50° C. Using coagulating bath as same as Example 1, spinning was carried out by means of a jet having a triangular orifice. Then the fiber was drawn at 4.0 times, and washing. The obtained fiber was dried under the conditions shown in Table 3, and then the fiber was relaxed in a saturated steam at 130° C. for 20 minutes. The properties of the resulted fibers were shown in Table 3.

TABLE 3

| Experiment No. | Drying Temperature (°C.) | Strength (g/d) | Elongation (%) | Remarks |
|---|---|---|---|---|
| 10 | 100 | 1.68 | 20 | Processability is not better. |
| 11 | 110 | 1.95 | 30 | Dry touch and ramie-like luster |
| 12 | 130 | 2.12 | 35 | Dry touch and ramie-like luster |
| 13 | 150 | 2.08 | 33 | Dry touch and ramie-like luster |
| 14 | 180 | 2.15 | 31 | Yellowing of the fiber observed. |

While the invention has been described in detail and with reference to specific embodiments thereof, it will be apparent to one skilled in the art that various changes and modifications can be made therein without departing from the spirit and scope thereof.

What is claimed is:

1. An acrylic fiber having an irregular form section and a ramie-like feeling produced by throwing a spinning solution composed of an acrylonitrile copolymer and an organic solvent, the viscosity of which is 120 poises or less at 50° C., into a coagulating bath using a jet having a triangular orifice, and thereafter drawing, washing and drying said fiber, and, wherein the section of the fiber has unmethodical surface unevenness and has at least two concave parts which has a ratio of the length l of a perpendicular from a tangental line between adjacent convex parts of said unevenness to the deepest part of the concave part to the diameter $D_1$ of a circumscribed circle, wherein the ratio $l/D_1$ is 0.05 or more, and the surface of said fiber is covered with a plurality of discontinuous creases having an average width of $1\mu$ or more and extending in the lengthwise direction of the fiber.

2. The acrylic fiber of claim 1, which comprises a blend of 90 to 50% by weight of substantive acrylic fibers and 10 to 50% by weight of fibers containing capillary voids.

3. The acrylic fiber of claim 1, wherein the jet stretch ratio is 2.0 or less.

4. The acrylic fiber of claim 1, wherein the jet stretch ratio is 0.5 to 1.5, and the fiber comprises a blend of 90 to 50% by weight of substantive fiber and 10 to 50% by weight of fiber containing capillary voids.

5. The acrylic fiber of claim 3 or 4, wherein the drying temperature of the fiber is in a range of 105° to 160° C.

* * * * *